US006561171B2

(12) United States Patent
Burgess

(10) Patent No.: US 6,561,171 B2
(45) Date of Patent: May 13, 2003

(54) CRANKCASE EMISSION CONTROL SYSTEM FOR CRANKCASE BREATHER

(75) Inventor: Stephen F. Burgess, Escalon, CA (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 10/082,910

(22) Filed: Feb. 26, 2002

(65) Prior Publication Data

US 2002/0117158 A1 Aug. 29, 2002

Related U.S. Application Data

(60) Provisional application No. 60/272,223, filed on Feb. 28, 2001.

(51) Int. Cl.[7] ..... F01M 13/00
(52) U.S. Cl. ..... 123/572
(58) Field of Search ..... 123/572, 573, 123/574, 41.86

(56) References Cited

U.S. PATENT DOCUMENTS 4,502,955 A 3/1985 Schaupp
4,569,323 A 2/1986 Okumura
4,602,595 A 7/1986 Aoki et al.
4,723,529 A 2/1988 Yokoi et al.
4,790,287 A 12/1988 Sakurai et al.
5,022,376 A 6/1991 Hudson, Jr. et al.
5,564,401 A 10/1996 Dickson
6,065,457 A 5/2000 Hoffmann et al.
6,412,478 B1 * 7/2002 Ruehlow et al. ..... 123/572

* cited by examiner

*Primary Examiner*—Marguerite McMahon
(74) *Attorney, Agent, or Firm*—Christopher H. Hunter

(57) ABSTRACT

A crankcase breather for an internal combustion engine has a housing including inlet ports which receive crankcase emissions from the engine, and an outlet port which directs oil-free gases back to the engine. A pair of filter elements are supported in the housing in adjacent relation. One filter element is a course filter to remove larger particulate in the emissions. The other filter element is a finer filter to remove smaller particulate, and to coalesce oil. A sump channel under the elements collects oil coalescing on the elements, and a drain opening in the channel to returns the oil to the engine. A second sump collects oil coalescing on the downstream surface of the second filter. An outlet port with a check valve in the second sump prevents oil being drawn into the breather on the clean side of the elements, but allows collected oil to drain back to the engine.

13 Claims, 8 Drawing Sheets

CRANKCASE EMISSION CONTROL SYSTEM FOR CRANKCASE BREATHER

CROSS-REFERENCE TO RELATED CASES

The present application claims the benefit of the filing date of U.S. Provisional Application Ser. No. 60/272,223; filed Feb. 28, 2001.

FIELD OF THE INVENTION

The present invention is directed to a crankcase emission control system. The crankcase emission control system is useful in the crankcase breather of an internal combustion engine, such as a diesel engine.

BACKGROUND OF THE INVENTION

Emission controls for internal combustion engines have become increasingly important as concerns over the environment have risen. One area where improvement has been noted is in crankcase emission controls.

Crankcase emissions result from gas escaping past the piston rings of an internal combustion engine and entering the crankcase due to high pressure in the cylinders during compression and combustion. As the blow-by gas passes through the crankcase and out the breather, the breather becomes contaminated with oil mist. The gas also contains wear particles and air/fuel emissions. In closed systems, the crankcase emissions are directed into the engine intake system causing internal engine contamination and loss of efficiency.

The oily crankcase emissions coat engine sites, such as the inside of engine compartments or chambers, fouling expensive components and increasing costs, such as clean-up, maintenance and repair costs. As the oily residue builds up on critical engine components, such as radiator cores, turbocharger blades, intercoolers and air filters, the residue becomes a "magnet" for dust, grit and other airborne contaminants. The accumulation of contaminants on these components reduces efficiency, performance and reliability of the engine.

Crankcase emission control systems filter the crankcase particulate emissions and separate the oil mist from the crankcase fumes. The separated oil is collected for periodic disposal or returned to the crankcase.. Since most of the crankcase particulate emissions are soluble hydrocarbons, returning the cleaned, oil-free crankcase emissions to the engine inlet increases engine efficiency.

One particularly useful crankcase emission control system is shown in U.S. Pat. No. 5,564,401, owned by Diesel Research, Inc. In this system, a high efficiency filter and crankcase pressure regulator are combined into a single unit connected between the engine crankcase breather and the engine air intake. The filter separates small sized particles to prevent contamination of turbochargers, the aftercooler, and internal engine components. The pressure regulator maintains acceptable levels of crankcase pressure over a wide range of crankcase gas flow and inlet restrictions.

In the Diesel Research system, the pressure control assembly is located in a housing body and is configured to regulate pressure through the system as well as agglomerate particles suspended in the blow-by gasses. Inlet and outlet ports direct the blow-by gasses into and out of the housing body from the engine block. A filter housing enclosing a replaceable filter is removably attached to the housing body to separate any remaining oil from the blow-by gasses. The filter element can be easily removed from the filter housing for replacement, after removing the filter housing from the housing body. The oil drains down and collects in a reservoir at the bottom of the filter housing. An oil drain check valve is located in the bottom wall of the filter housing, and includes a free-floating (one-way) check valve. The check valve is connected through a separate return line to the oil pan or engine block to return the collected oil to the engine.

While the Diesel Research system has received acceptance in the marketplace as being a considerable improvement over previous systems, it is located external to the engine, and therefore requires additional space, plumbing, and must be mounted for easy access for replacement of the filter.

It is also known to install crankcase emission control systems internal to the cylinder head of the engine, such as shown in Aoki et al, U.S. Pat. No. 4,602,595. In the Aoki system, a pair of filter elements are supported vertically in the cylinder head. The first filter separates larger particles and oil droplets, while the second filter absorbs any fog-like fine particles which pass through the first filter. The oil separated by the first filter collects and drains down into an oil reservoir, where it passes through a check valve and is returned to the crankcase.

While the Aoki system conserves space, the cylinder head cover must be specially modified to support the filter elements. This adds machining cost. Further, there is no provision for draining the oil collected downstream of the second filter. It appears that any oil collected downstream of the second filter must drain back through the second filter and into the sump between the first and second filters, where it can then return to the engine through the check valve.

As such, it is believed there is a demand in the industry for a further improved crankcase emission control system for a crankcase breather, and more particularly for a compact filter assembly mounted within with the cylinder head of the engine; which does not require costly modification to the cylinder head cover; and which allows collected oil to easily return to the engine during operation and/or after shutdown.

SUMMARY OF THE PRESENT INVENTION

The present invention provides a novel and unique crankcase emissions control system. The crankcase emission control system includes a filter assembly which is compact and fits within the cylinder head of the engine; does not require costly modification to the cylinder head cover; and allows collected oil to easily return to the engine.

According to the present invention, the filter assembly includes a housing adapted to be located within a cylinder head of an engine. The housing includes upper and lower casing members. A lower of the casing members includes one or more inlet ports which receive the crankcase emissions from the engine. An upper of the casing members is located flush against the inside surface of the cylinder head cover, and includes an outlet port. The outlet port of the upper casing member is received in the outlet port of the cylinder head cover and directs substantially oil-free gases back to the inlet of the engine for combustion. The housing can be fixed to the underside of the cylinder head cover with bolts.

The casing members support a pair of elongated filter elements. A first of the filter elements is a course filter, designed to remove larger oil particulate in the crankcase emissions. The other of the filter elements is a finer filter, designed to remove smaller oil particulates, and to coalesce oil in the emissions. The filter elements are located in adjacent, preferably surface-to-surface relation to one another with the first (coarser) filter element located upstream of the second (finer) filter element. A small sump channel is provided in the lower casing member under the elements to collect any oil agglomerating on the elements. A small drain opening is provided in the first sump to return oil to the engine.

A larger sump chamber is provided downstream of the second filter. The larger sump chamber collects oil coalescing on the downstream surface of the second filter. An outlet port is provided in the second sump, and a check valve is supported in the outlet port. The check valve has a simple, T-shaped structure and is designed to prevent unfiltered gases from being drawn into the second sump from the negative pressure in the filter housing when the engine is operating, but allows oil to easily drain back to the engine when the engine is idle or shut down. In the latter case, the collected oil forces the check valve downwardly into an open position to allow the oil to drain through the port back to the engine.

A plurality of fingers on the downstream side of the second filter element support the filter elements in the housing, and allow the filtered emissions to pass from the filter elements to the outlet port and back to the engine.

Further features of the present invention will become apparent to those skilled in the art upon reviewing the following specification and attached drawings.

DETAILED DESCRIPTION OF THE PREFERRED EMBODIMENT

Figure 1:
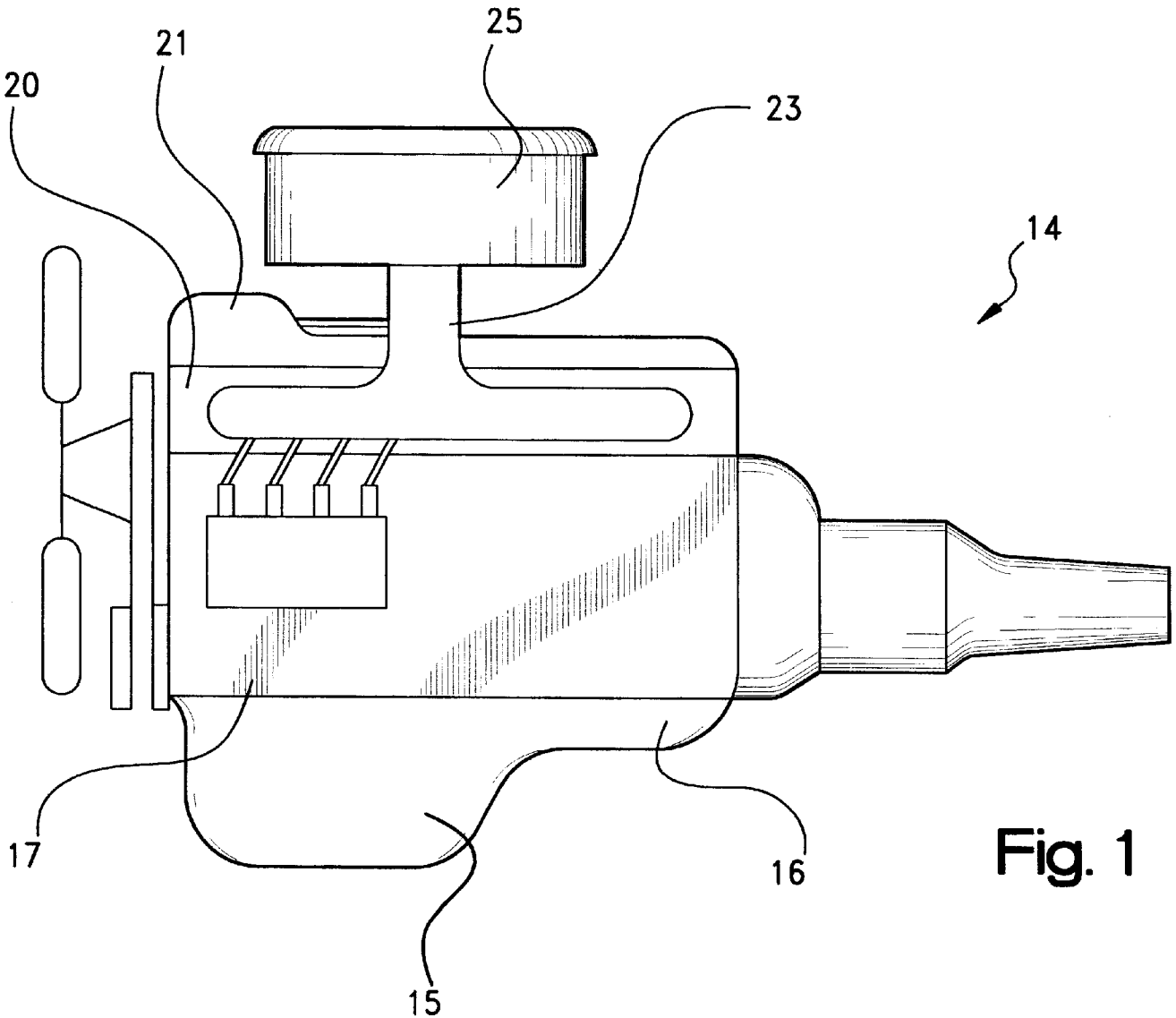
FIG. 1 is a side view of an engine including a crankcase filter assembly constructed according to the principles of the present invention.

Referring to the drawings, and initially to FIG. 1, an internal combustion engine is indicated generally at 14, and includes an oil pan 15, a crankcase 16, a cylinder block 17, a cylinder head 20, a cylinder head cover 21, and a carburetor having an air suction passage 23 connected to an air filter 25.

Figure 2:
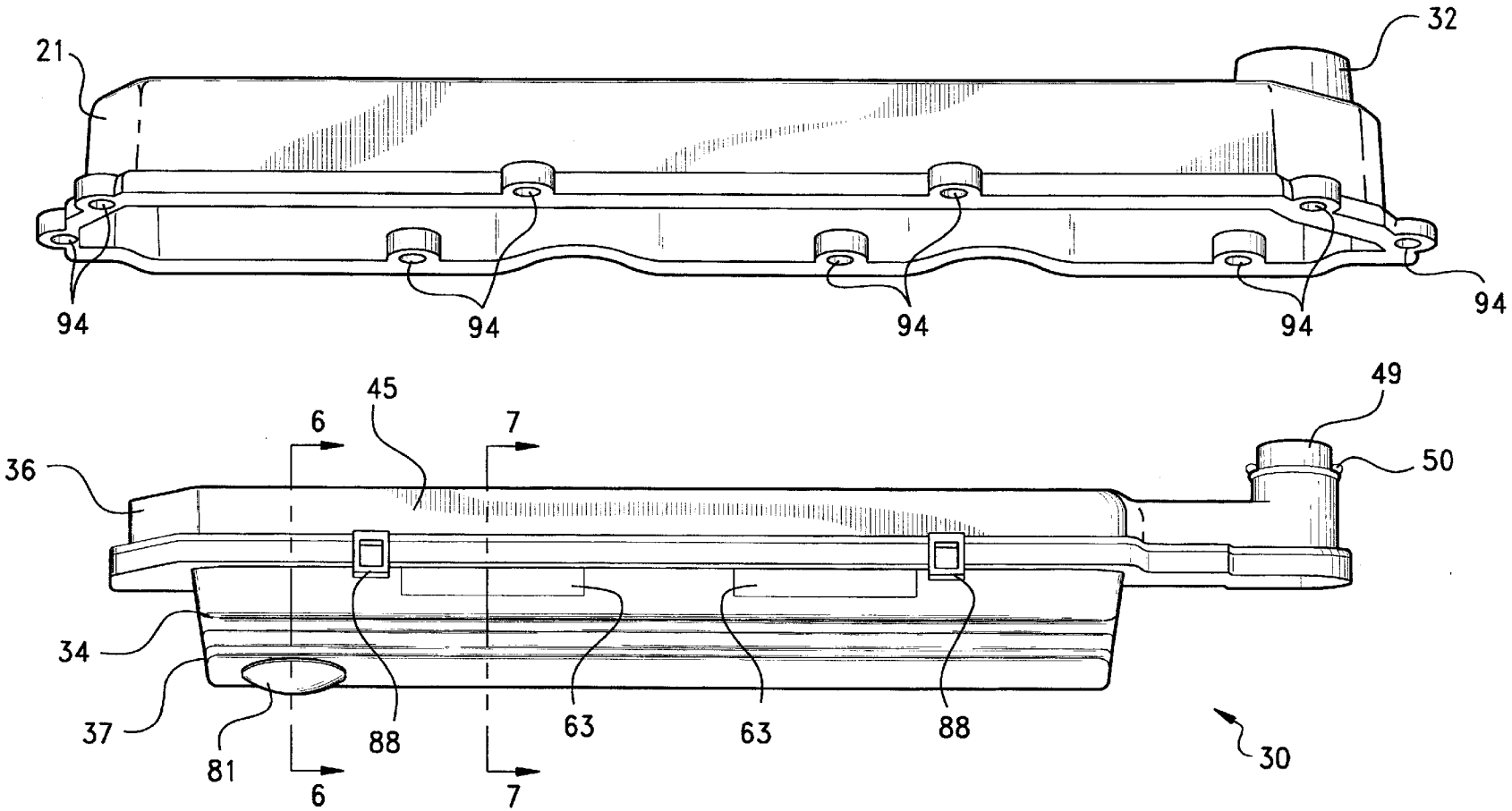
FIG. 2 is a side view of a first embodiment of the crankcase filter assembly, shown separated from a cylinder head cover.

As shown in FIG. 2, a crankcase breather, indicated generally at 30, is mounted to the inside surface of the cylinder head cover 21. The crankcase breather 30 receives crankcase emissions escaping past the piston rings of the engine, and filters (separates out) the oil in the gasses and directs the substantially oil-free gases back to the engine through outlet port 32 in the cover to an intake manifold (not shown) for combustion.

Figure 3:
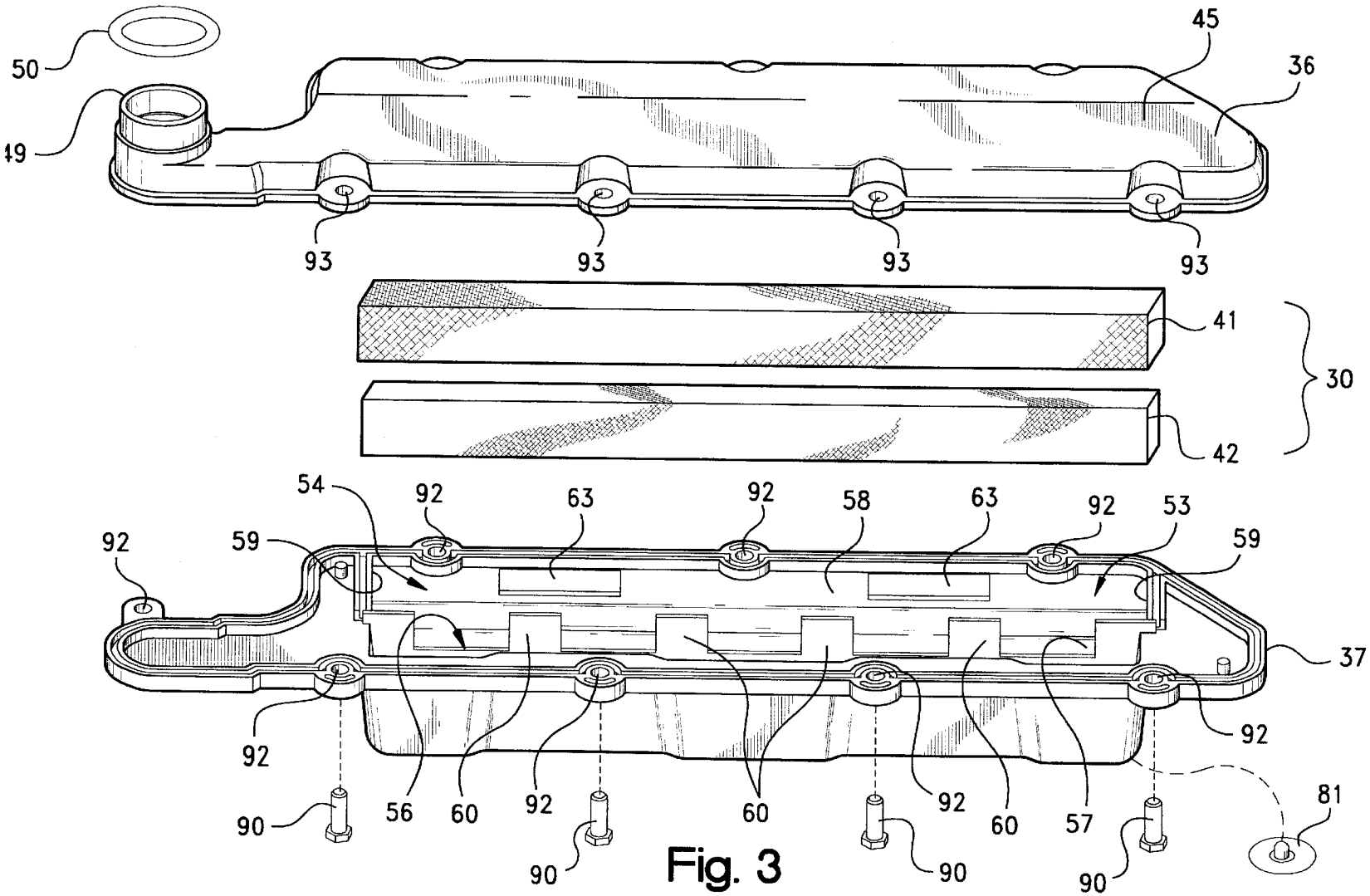
FIG. 3 is an exploded view of the crankcase filter assembly of FIG. 2.
Figure 4:
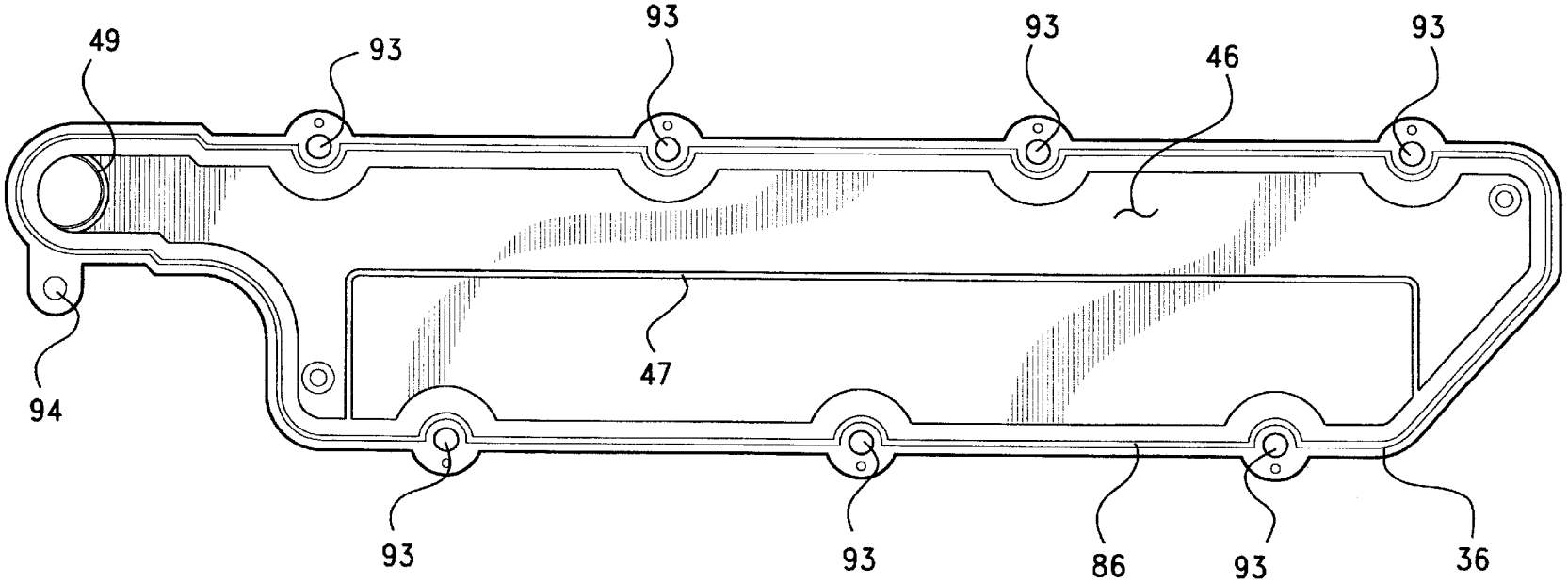
FIG. 4 is a perspective view from beneath the upper casing member of the crankcase filter assembly.

Referring also to FIGS. 3 and 4, the crankcase breather 30 includes a housing 34, defined by an upper casing member 36 and a lower casing member 37. A pair of elongated filter elements 41, 42 are supported within the housing 34 to separate the oil from the crankcase emissions, as will be explained herein in more detail. The upper casing member 36 has an elongated trough shape. The outer, upper surface 45 of the upper casing member has a geometry preferably the same as the inner lower surface of the cylinder head cover (e.g., flat), such that the upper casing member can be located flush against the inside surface of the cylinder head cover. The inner, lower surface 46 of the upper casing member. 36 is also for the most part flat, but includes a relatively thin wall 47 which outwardly bounds and supports the upper portion of the filter elements 41, 42. An annular outlet port 49 is formed at one end of the upper casing member in a location spaced apart from the filter elements, and projects outwardly from the upper surface 45. The outlet port 49 has a dimension which is closely received within the annular outlet port 32 in the cylinder head cover 21. An O-ring 50 can be provided between the outlet port 49 of the upper casing member and the outlet port 32 in the cylinder head cover to provide a gas-tight seal.

Figure 5:
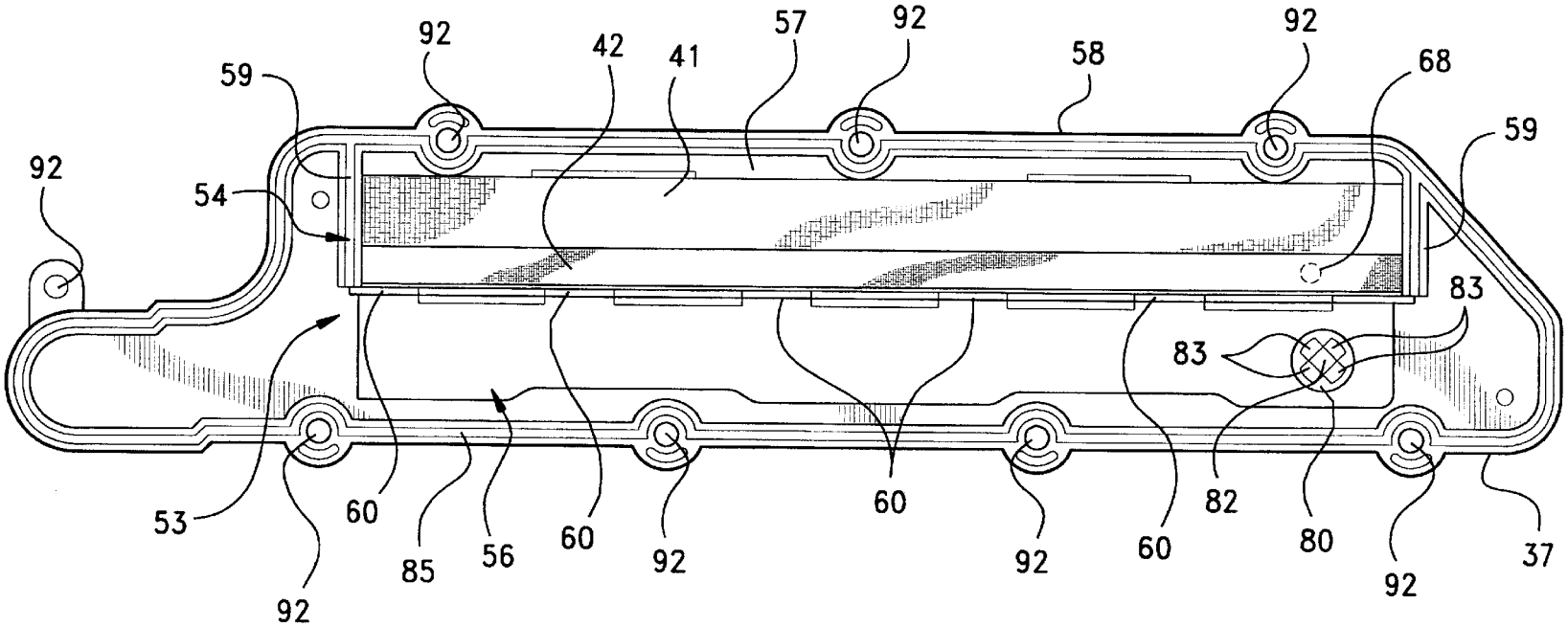
FIG. 5 is a plan view, from the top, of the lower cover, showing the filter elements installed.
Figure 7:
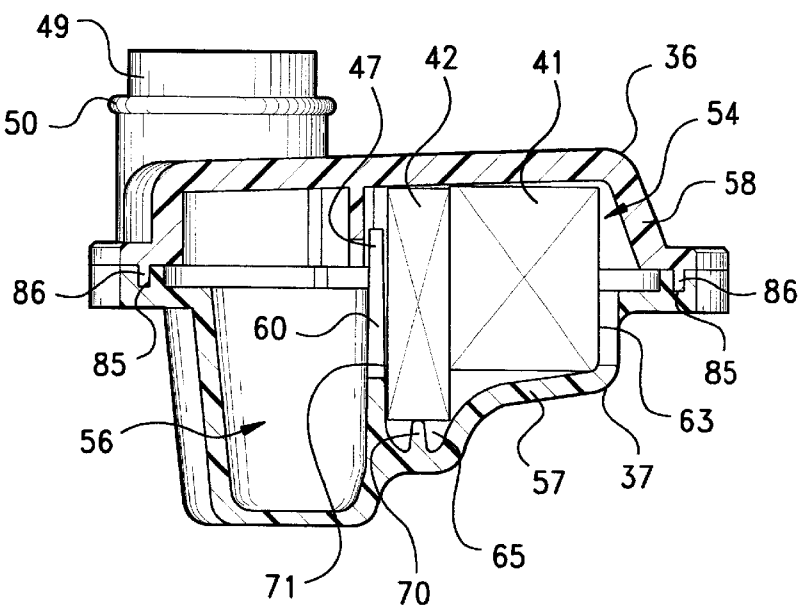
FIG. 7 is a cross-sectional end view of the crankcase filter assembly taken substantially along the plane described by the lines 7—7. of FIG. 2.
Figure 6:
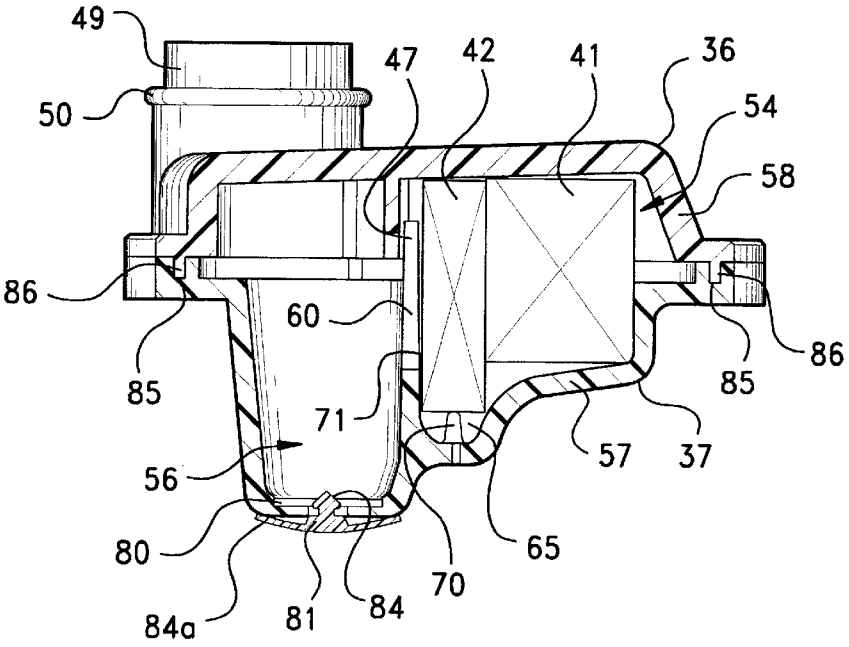
FIG. 6 is a cross-sectional end view of the crankcase filter assembly taken substantially along the plane described by the lines 6—6 of FIG. 2.

Referring also to FIGS. 5–7, the lower casing member 37 has a similar elongated trough shape, and is configured to seal closely against the upper casing member 36. The lower casing member 37 has an internal main chamber, indicated generally at 53, extending across almost the entire length of the lower casing member. The main chamber is bisected along its length into a filter chamber portion, indicated generally at 54, and a collection chamber portion, indicated generally at 56. The filter chamber portion 54 and collection chamber portion 56 are located in side-by-side, adjacent relation.

The filter chamber portion 54 has a bottom wall 57, a vertical front wall 58 and sidewalls 59 bounding the outer periphery of the bottom wall. A series of elongated, vertically extending thin and flat fingers as at 60 project upwardly from the bottom wall and separating the filter chamber portion 54 from the collection chamber portion 56. The fingers 60 are preferably evenly-spaced along the boundary between the chamber portions, with the number being sufficient to support the downstream filter element 42 without causing substantial pressure drop or otherwise substantial interruption of the fluid flow into the collection chamber 56. The fingers 60 preferably project upwardly toward the upper casing member sufficiently to overlap the upstream side of the wall 47 of the upper casing member when the casing members are assembled (see FIGS. 6, 7). This overlap provides support for the upper distal ends of the fingers. The front wall 58, sidewalls 59 and fingers 60 outwardly bound the lower portion of the filter elements 41, 42. The front wall 58, sidewalls 59 and fingers 60 of lower casing member 37, and wall 47 of upper casing member 36 are sufficiently spaced so as to closely support the filter elements along their length and width when the elements are located between the casing member.

The front wall 58 has at least one, and preferably two or more, evenly-spaced, elongated inlet ports 63 spaced across the front wall to allow crankcase emissions to enter the filter chamber portion. The number and dimension of the inlet ports can be easily determined based on the desired flow through the crankcase breather.

A narrow sump channel 65 (FIG. 6, 7) is formed in the bottom wall 57 of the lower casing member, along the boundary separating the filter chamber portion from the collection chamber portion, and extending between the sidewalls 59. The bottom wall 57 is preferably slightly angled to facilitate causing any collected oil to flow into the sump channel 65. A small drain opening 68 is formed along the sump, preferably toward one end, which allows collected oil to exit the crankcase breather assembly and return to the valve train. A rib or flange 70 is provided centrally along the channel to support the filter elements (and for the most part, the downstream element 42) along the channel, and prevent the elements from interfering with the flow of oil along the channel.

The filter elements 41, 42 are preferably both formed from material appropriate for the particular application, for example an open foam material comprised of a combination of nylon and polyester, although other materials are of course possible. The elements could also individually be made from different material. The first element 41 is a primary filter element, and has a relatively coarse (less dense) structure designed to agglomerate larger oil particles (and other larger contaminants) in the emissions entering through the inlet ports 63. The first element 41 is located against the front endwall 58 and against ports 63. Oil collected in the primary filter element drains down to the bottom wall 57, and then into sump 65. The primary element is illustrated as having a rectangular shape, although other shapes are possible.

The second element is a secondary filter and is located downstream of the primary element in adjacent, surface-to-surface contact with the primary element. The secondary element has a finer (more dense) structure than the primary element 41, designed to agglomerate slightly smaller oil particles (and other slightly smaller contaminants) in the emissions passing through the primary filter, and to coalesce oil passing through the element. The secondary filter element is supported against the fingers 60, adjacent the collection chamber 56. Oil collected in the secondary filter can also drain down to the bottom wall 57, and pass into sump 65, however, oil primarily collects on the downstream surface 71 of the secondary filter element, from where it drains downwardly into the collection chamber 56, which therefore also acts as a sump. The secondary filter is also illustrated as having a rectangular shape, although again, other shapes are possible.

The secondary filter typically has a slightly thinner dimension than the primary filter because of its finer (denser) structure, although this could vary depending upon the particular application. The dimensions and efficiencies of the primary and secondary filter elements can be easily determined based on the anticipated emission gasses to be filtered and the required life of the breather. It is believed the filter elements of the present invention can be used for the life of the engine. without replacement, although some applications might require a highly efficient separation of the oil in the emissions, which may necessitate replacing the elements (or the entire breather) at regular intervals.

While separate primary and secondary filter elements are shown, it is possible that a single, unitary filter element could be provided with a layered or varying filter structure. It is also possible that only a single filter structure could be provided, that might be less efficient than a multiple filter structure, but would still remove significant oil particles in the emissions. Of course, it is further possible that three or more filter elements could be provided, for even more efficient filtering of emission gasses, depending upon the particular application and customer demands.

The collection chamber portion 56 also preferably has an elongated trough shape extending across almost the entire lower casing member, with sufficient dimension to collect oil draining from the downstream surface of the secondary filter element 42. Outlet port 49 is located so as to open into the collection chamber portion. A return port 80 (FIGS. 5, 6) is formed along the length of the collection chamber portion 56, preferably toward one end, and preferably toward the end of the lower casing member with opening 68. A one-way check valve 81 is located in return port 80. To this end, return port 80 preferably includes a central opening 82 supported by members 83 projecting radially inward from the area bounding the port. Check valve 81 is formed from resilient material with a simple T-shape, with the central post 84 of the check valve slidingly received in opening 82. The head 84*a* of the check valve is located external to the lower casing member 37. The positive pressure within the crankcase (and negative pressure in the breather) when the engine is operating urges the head of the check valve into sealing relationship with the lower surface of the lower casing member. When the engine is shut down or idling, and the pressure within the crankcase falls, oil collected in the collection chamber portion 56 forces the check valve 81 into an open position, with the head 85 spaced apart from the inner casing member, which allows the oil to drain through port 80 back to the crankcase. The check valve prevents emissions from entering the clean side of the crankcase breather assembly during engine operation.

To orient and seal the lower casing member 37 to the upper casing member 36, the lower casing member can have a continuous thin groove or channel 85 (see FIGS. 5–7) extending around the periphery thereof, while the upper casing member can have a continuous thin wall or flange 86 (see FIGS. 4, 6, 7) extending around the periphery thereof, with the flange 86 located so as to be closely received in the channel 85 as a tongue-in-groove. While not shown, a resilient seal or other sealing means could also be provided between the casing portions in addition, or alternatively to the tongue-in-groove. The filter elements are otherwise supported directly against the casing members 36, 37 so that the emissions must pass through the filter elements 41, 42 before passing to the outlet port 49 and returning to the engine.

Each of the casing members 36, 37 is preferably formed unitarily in one piece from an inexpensive, lightweight material which can withstand the operating conditions of the engine. Preferably, each casing member is formed from an appropriate plastic, using conventional forming techniques, such as molding.

The casing members can be held together after assembly and prior to mounting to the cylinder head cover by a series of clasps 88 (FIG. 2) located around the periphery of the housing, or by other appropriate means such as by bolts, adhesive, etc. Since the breather is formed of relatively inexpensive material, the entire crankcase breather can be throw away when the filter elements are spent, although it is also possible that the casing members could be disassembled, and fresh filter elements located therebetween, if it is desirable to reuse the casing members. Again, it is noted that one of the advantages of the present invention is that with an appropriate selection of the filter elements, the breather can be used for the life of the engine, without replacement.

The crankcase breather 30 can be mounted to the inside, bottom surface of the cylinder head cover in any appropriate manner. Preferably, the crankcase breather is attached with threaded bolts 90 inserted through openings 92 formed in the lower casing member, and aligned openings 93 formed in the upper casing member. The bolts 90 are received in threaded bores 94 formed in the cylinder head cover 21, and assist in keeping the casing members together during operation of the engine. Beyond bolt bores 94, or other similar simple attachment technique such as threaded studs, no significant changes have to be made to the cylinder head cover 21, as the crankcase breather fits neatly and compactly within the cover.

As should be apparent from the above description, emissions entering the inlet port(s) 63 in the lower casing member enter the upstream, course filter element 41, where large oil particles (and other large particle contaminants) are agglomerated, and settle out or drain down to the sump channel 65 in the bottom wall 57. The collected oil drains down through opening 68 for return to the engine. The partially-filtered emissions then pass through the downstream, finer filter element 42, where most, if not all, of the remaining oil particles (and other smaller particle contaminants) are removed. The oil in the finer filter can also drain downwardly into the sump channel 65, however, most oil collects on the downstream surface of the finer filter 42, from where it drains downwardly into the collection chamber portion 56. The pressure in the engine during operation normally keeps the check valve 81 closed, however the collected oil can return to the engine during idle or shutdown when the crankcase pressure is reduced and the collected oil in the collection chamber opens the check valve. The substantially oil-free emissions then pass through the return port 49 of the crankcase breather and through the outlet port 32 in the cylinder head cover for return to the engine for combustion.

Figure 8:
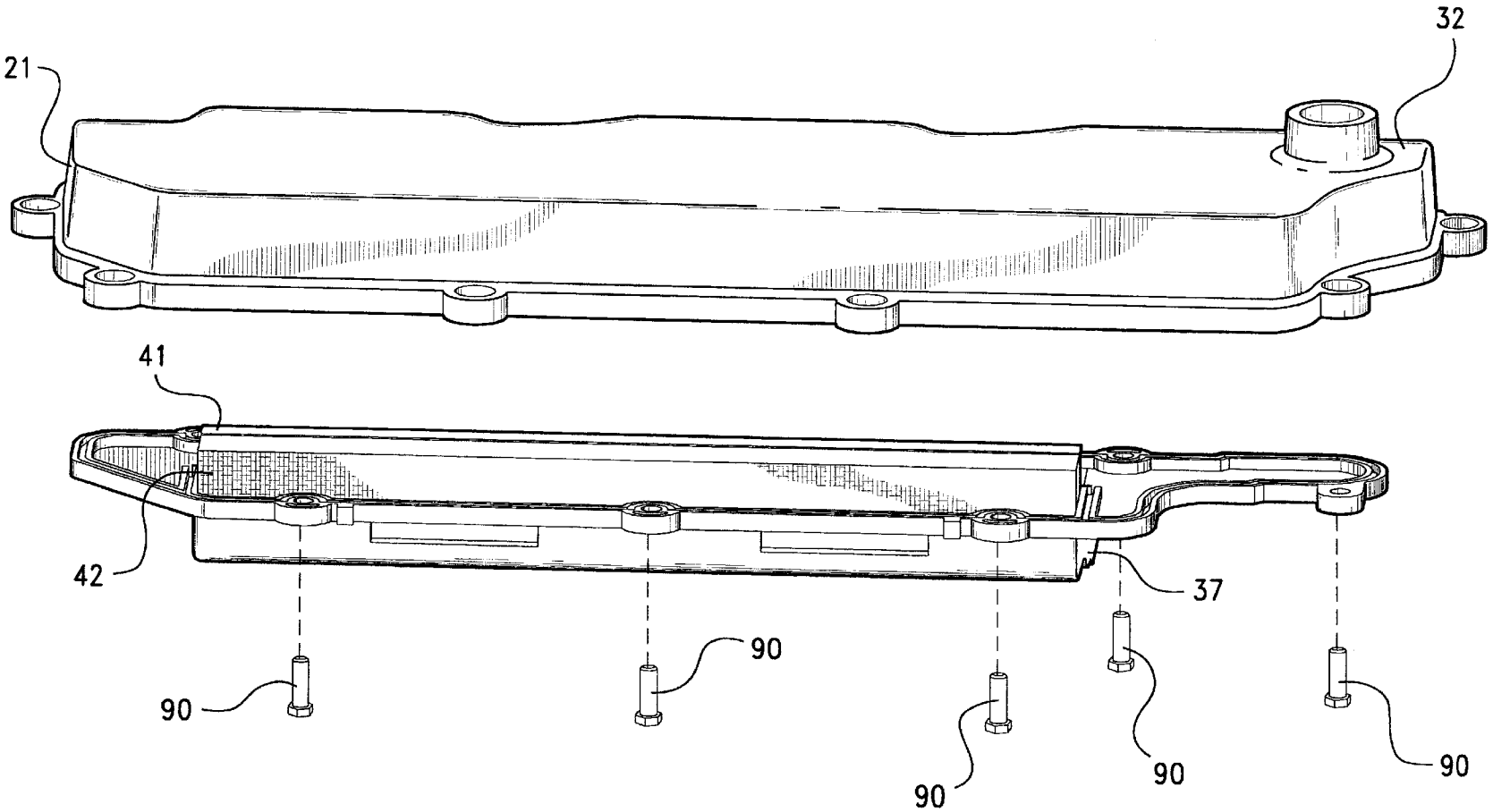
FIG. 8 is a side view of the crankcase filter assembly constructed according to a second embodiment of the present invention, shown separated from a cylindrical head cover.
Figure 9:
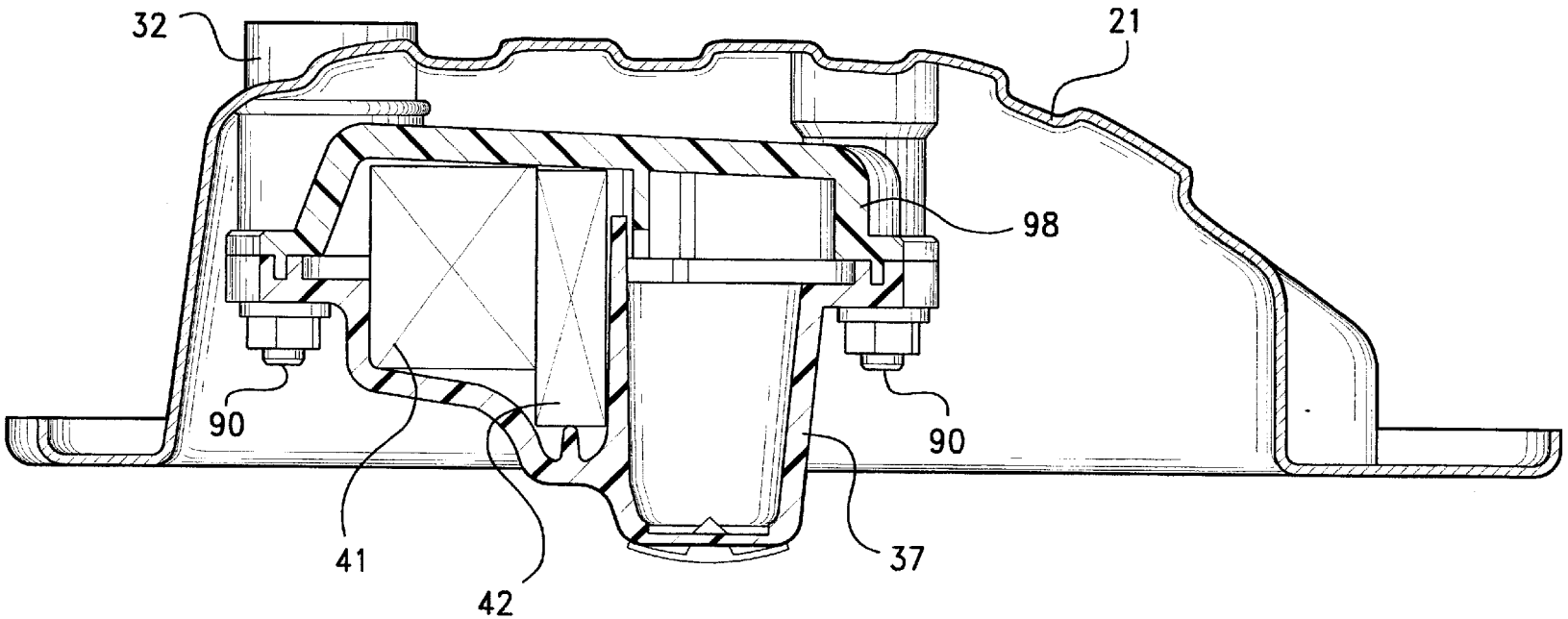
FIG. 9. is a cross-sectional side view of the crankcase filter assembly of FIG. 8, shown assembled with the cylinder head cover.

An alternative embodiment of the crankcase breather assembly is illustrated in FIGS. 8 and 9. In this embodiment, the crankcase breather uses the inside surface of the cylinder head cover 21 as the upper cover for the breather. In this embodiment, the lower casing member 37 and cylinder head cover 21 define the housing for the filter elements 41 42. The inside surface of the cover 21 can include a thin wall 98 having essentially the same structure and function as wall 47, to support the upper portion of the filter elements. The lower casing member 37 is sealed directly to the lower surface, and fastened in the same manner as described above, such as with threaded bolts 90. The lower casing member 37 and filter elements 41, 42 otherwise preferably have the same structure as described above, and operate in the same manner to remove oil from the crankcase emissions.

The crankcase emission control system of the present invention thereby has a filter assembly with a simple, relatively inexpensive structure which is relatively easy to manufacture. The filter assembly is compact and fits within the cylinder head of the engine; does not require costly modification to the cylinder head cover; and does not allow oil to collect in the filter.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A crankcase breather for removing oil from blow-by gasses in an internal combustion engine, said crankcase breather comprising:

an elongated housing having an internal filter chamber and an internal collection chamber, a gas flow inlet port into the filter chamber, and a gas flow outlet port from the collection chamber;

a pair of elongated filter elements supported adjacent one another in the filter chamber, the filter elements located such that a first of said filter elements initially receives the blow by gasses from the gas flow inlet port and has an efficiency sufficient for separating oil particulate of a first size from the blow by gasses, and a second of the filter elements then receives the blow by gasses from the first filter element and has a efficiency sufficient for separating oil particulate of a second, smaller size from the blow by gasses;

the housing including a drain opening in the filter chamber located to receive oil collected by the first filter element and to return the oil to the engine, and a separate return port in th e collection chamber disposed to receive oil collected by the second filter element and to return the oil to the engine, a check valve disposed in the return port to prevent blow-by gasses from the engine directly entering the collection chamber through the return port, but allowing oil to drain out from the collection chamber through the return port.

2. The crankcase breather as in claim 1, wherein the filter chamber includes a first sump with the drain opening, and the collection chamber includes a second sump with the oil return port.

3. The crankcase breather as in claim 2, wherein a plurality of fingers are formed integrally with the housing to support the filter elements, said fingers located along a boundary separating the filter chamber from the collection chamber.

4. The crankcase breather as in claim 1, wherein a plurality of fingers formed integrally with the housing support the filter elements in the housing.

5. The crankcase breather as in claim 1, wherein said housing includes a pair of casing members disposed in sealing relation to one another,. one of said casing members including the gas flow inlet port, and the other of the casing members including the gas flow outlet port.

6. The crankcase breather as in claim 5, wherein a plurality of fingers are formed integrally with one of the casing members to support the filter elements in the housing.

7. The crankcase breather as in claim 1, wherein said housing includes a cylinder head cover and a casing member, said cylinder head cover including the gas flow outlet port, and the casing member including the gas flow inlet port.

8. The crankcase breather as in claim 7, wherein a plurality of fingers are formed integrally with the casing member to support the filter elements in the housing.

9. A crankcase breather for an internal combustion engine, said crankcase breather comprising:

a housing having an internal main chamber, a gas flow inlet port into the chamber, and a gas flow outlet port from the chamber;

filter means supported in the internal main chamber for separating oil from the blow-by gasses;

the housing including a first sump with a drain opening in a lower portion of the housing located to receive oil agglomerated by the filter means and to return the oil to the engine, and a return port in the lower portion of the housing located to receive oil collected on a downstream surface of the filter means and to return the oil to the engine, a check valve disposed in the return port to prevent blow-by gasses from the engine directly entering the main chamber through the return port, but allowing oil to drain out from the main chamber through the return port.

10. The crankcase breather as in claim 9, wherein the filter means includes a first filter element and a second filter element, and the drain opening is located downstream of the first filter element and upstream from the second filter element.

11. The crankcase breather as in claim 10, wherein the first and second filter elements are supported in adjacent relation to one another in the main chamber.

12. The crankcase breather as in claim 9, wherein the filter means has varying efficiency, with the efficiency of the filter means increasing from an upstream side of the filter means to a downstream side of the filter means.

13. The crankcase breather as in claim 9, wherein a plurality of fingers are formed integrally with the housing to support the filter means.

* * * * *